US005505155A

United States Patent [19]

Adams

[11] Patent Number: 5,505,155

[45] Date of Patent: Apr. 9, 1996

[54] SUBMARINE PROPULSION SYSTEM

[75] Inventor: Richard Adams, Portsmouth, United Kingdom

[73] Assignee: GEC Marconi Ltd., Middlesex, United Kingdom

[21] Appl. No.: 294,860

[22] Filed: Aug. 29, 1994

[30] Foreign Application Priority Data

Sep. 3, 1993 [GB] United Kingdom ..... 9318303

[51] Int. Cl.[6] ..... B63G 8/08

[52] U.S. Cl. ..... 114/338; 440/53

[58] Field of Search ..... 114/312, 313, 114/337, 338; 244/7 C, 12.4, 56, 66; 440/53

[56] References Cited

U.S. PATENT DOCUMENTS

| | | | |
|---|---|---|---|
| 2,873,710 | 2/1959 | Morel | 114/330 |
| 3,250,238 | 5/1966 | Reder | 114/313 |
| 3,302,602 | 2/1967 | Korganoff . | |
| 3,521,589 | 7/1970 | Kemp | 114/338 |
| 4,573,929 | 3/1986 | Savikurki et al. | 440/54 |

FOREIGN PATENT DOCUMENTS

| | | | |
|---|---|---|---|
| 385827 | 9/1990 | European Pat. Off. | 114/338 |
| 1277356 | 3/1962 | France . | |
| 2677949 | 12/1992 | France . | |
| 3626434 | 2/1988 | Germany . | |
| 2014929 | 9/1979 | United Kingdom . | |

*Primary Examiner*—Jesus D. Sotelo
*Attorney, Agent, or Firm*—Lowe, Price, LeBlanc & Becker

[57] ABSTRACT

A submarine propulsion system for a submersible vehicle has two motors mounted on respective support arms able to rotate about two axes relative to the submersible vehicle. Rotation of each arm about its first axis moves its respective motor out of a storage recess, in which it is stored when not in use, into an operating position and rotation of the same arm about the other axis moves its respective motor between two operating positions in which it generates vertical and horizontal thrust respectively.

3 Claims, 3 Drawing Sheets

FIG. 1A
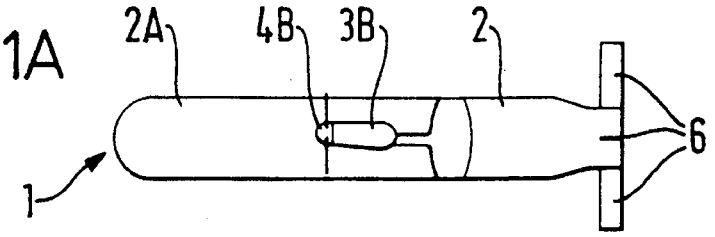
FIG. 1B
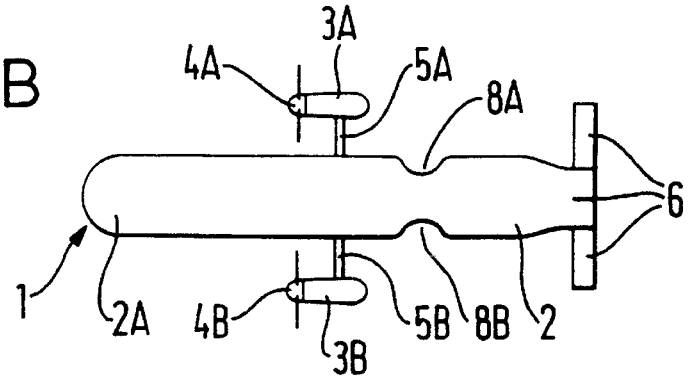
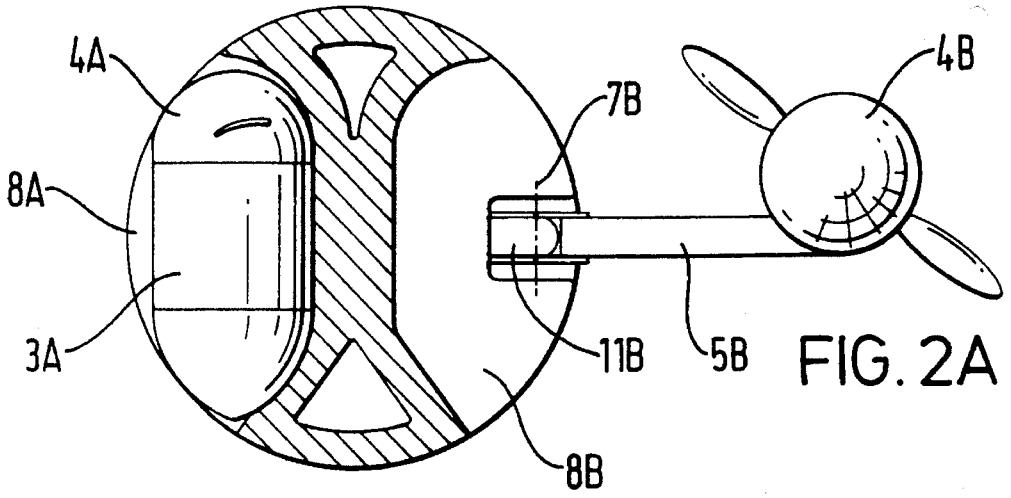
FIG. 2A
FIG. 2B
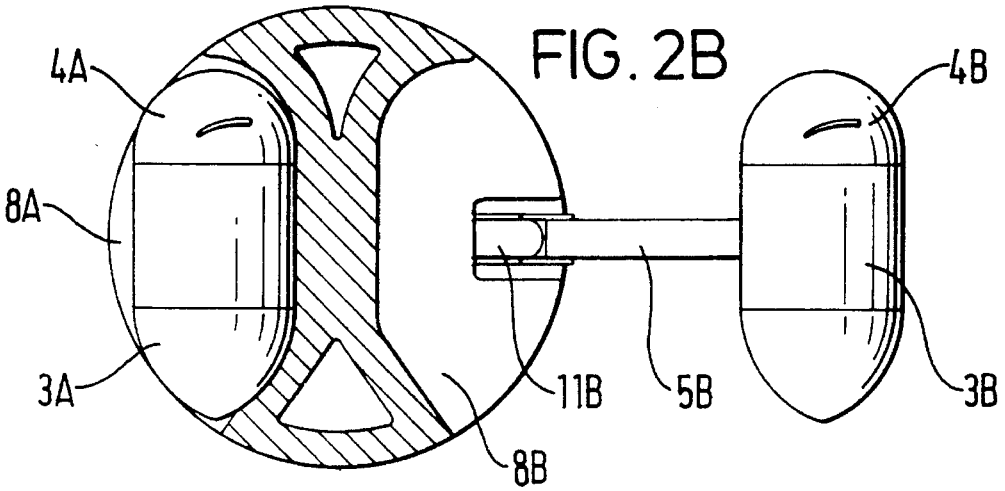

FIG. 3A
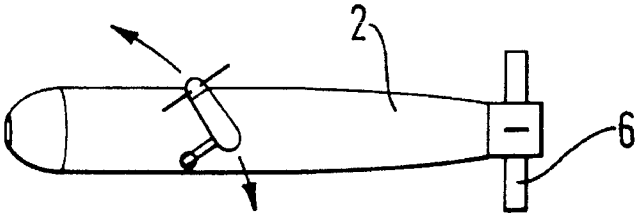
FIG. 3B
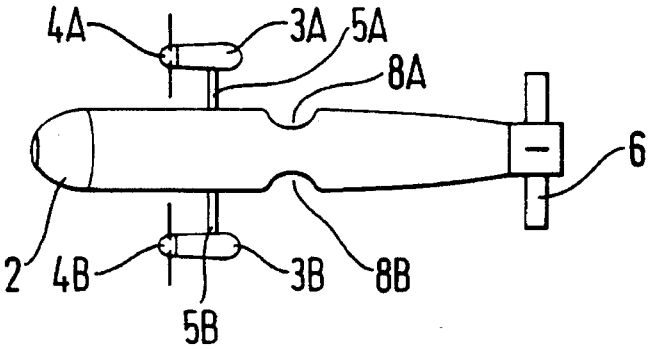
FIG. 3C
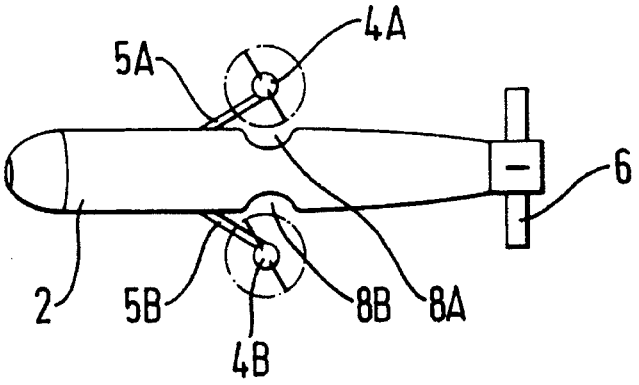
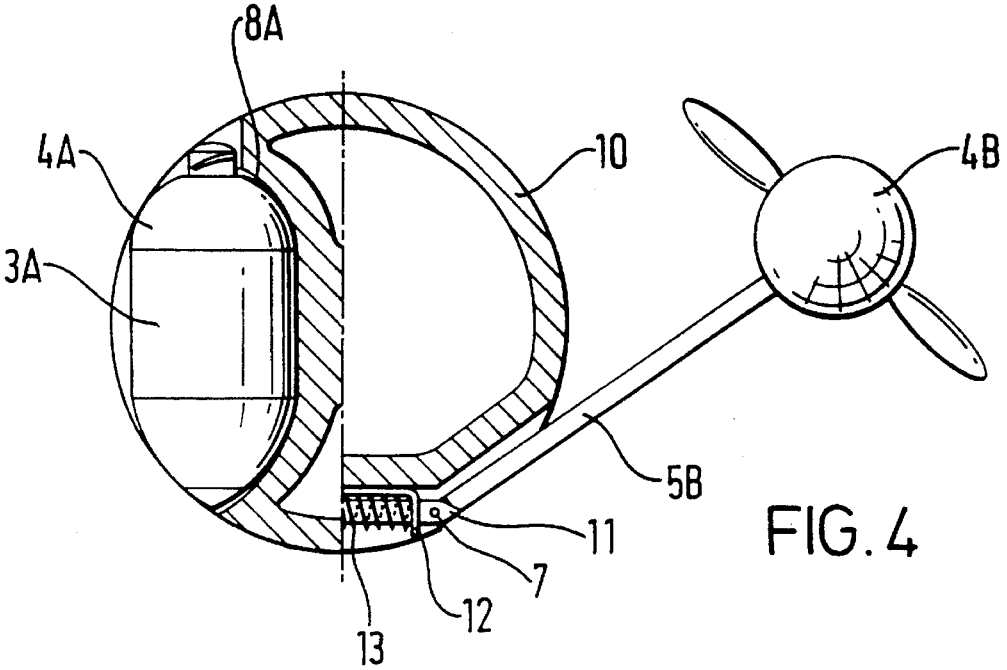
FIG. 4

SUBMARINE PROPULSION SYSTEM

BACKGROUND OF THE INVENTION

This invention relates to a submarine propulsion system and specifically to a submarine propulsion system for an expendable unmanned underwater vehicle.

In attempting to dispose of underwater mines it has been usual to place an explosive charge adjacent the mine and then detonate the explosive charge hoping that this will cause sympathetic detonation of the mines warhead, destroying the mine, or at least render the mines sensor and triggering mechanisms inoperative, rendering the mine harmless. Placement of such charges has been carried out by a human diver or by a remote controlled submersible.

Both of these methods have drawbacks. The main drawback is the high risk to the diver or submersible and it is in fact due to the unacceptably high risk to the diver that submersibles are used. However the very high cost of a submersible able to carry an explosive charge to a mine location, deploy the charge adjacent the mine, and return to the mother ship makes loss of the submersible unacceptable, in addition the weight and bulk of the submersible is such that only a very limited number can be stowed aboard a warship and as a result the vessels mine sweeping capability could rapidly be lost due to destruction of the submersibles. A further disadvantage is that the time taken to dispose of a mine is by these conventional methods is quite long due to the need to get the diver or submersible to a safe distance before detonating the charge and the need for the diver or submersible to return to the mother ship, which must always remain at a safe distance from the mine throughout the operation, to pick up further explosive charges. Since the combined explosive effect of the mine warhead and the disposal charge may be very great the safe distance is relatively large.

It has been proposed to overcome these drawbacks by employing an expendable remote controlled submersible containing an explosive charge and simply moving the submersible into close proximity to a mine and detonating the charge, destroying the submersible and hopefully detonating the mine warhead or disabling the mine sensor and detonation mechanisms simultaneously. The bulk and expense of such an expendable submersible can be very much less than that of a conventional reusable submersible since there is no need to include any explosive charge deployment mechanism, the range and operational life need only be sufficient for a one way trip to the target mine and all of the control and power systems can be 'one shot' devices.

In designing such an expendable submersible it has proved difficult to make the submersible easily and accurately controllable so as to ensure that it can be got into close proximity to the target mine before detonation while simultaneously keeping the submersible cheap and light so as to allow a large number to be carried aboard the mother ship and to allow large numbers to be purchased, the arrangement of motors and propellors to provide forward thrust and the necessary control surfaces to allow controlled horizontal and vertical movement of the submersible has proved particularly difficult.

SUMMARY OF THE INVENTION

This invention was intended to provide an underwater propulsion system overcoming these problems, at least in part.

This invention provides a submarine propulsion system for use in a submersible vehicle comprising two motors mounted on support arms and arranged when not in use with each stored in a respective recess in the submersible vehicle and the support arms being arranged for rotation about two axes relative to the submersible vehicle so that rotation about the first axis moves the motor out of the recess and into an operating position and rotation of the support arm about the other axis moves the motor between two operating positions in which it generates thrust in two perpendicular directions, rotation of the support about the second axis being controlled by the amount of thrust generated by the motors.

This provides a cheap and simple method of controlling movement of the submersible vehicle and allows the vehicle to be made compact for easy storage.

BRIEF DESCRIPTION OF THE DRAWINGS

Submersible vehicles embodying the invention will now be described by way of example only with reference to the accompanying diagrammtic figures in which;

FIG. 1A shows a side view of an expendable under water mine clearing vehicle, FIG. 1B shows the vehicle of FIG. 1A in plan view, FIG. 2A shows in cross section through the vehicle of FIGS. 1 showing the motors in the stored and horizontal thrust positions, FIG. 2B shows a cross section through the vehicle of FIGS. 1 with the motor in the vertical thrust position, FIG. 3A shows a side view of a second type of expendable submarine mine clearing vehicle incorporating the invention in side view, FIG. 3B shows a plan view of the vehicle of FIG. 3A with the motors in the forward thrust position, FIG. 3C shows a plan view of the vehicle of FIG. 3A with the motors in the verticle thrust position, and FIG. 4 shows a cross section through the vehicle of FIG. 3 with one motor in the stored position and the other motor deployed in the forward thrust position, similar parts having the same reference numerals throughout.

DESCRIPTION OF THE PREFERRED EMBODIMENTS

Figure 2C:
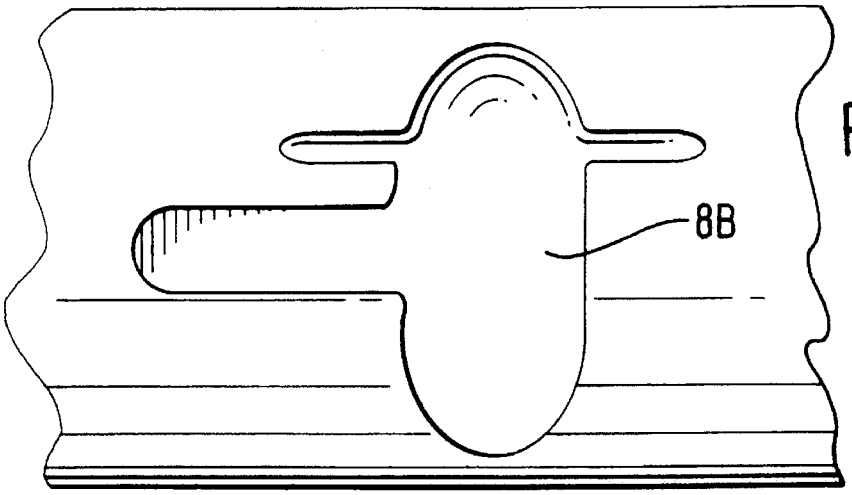
FIG. 2C shows the shape of the recess in the hull of the vehicle of FIG. 1 in which a motor is stored.

Referring to FIGS. 1A and 1B the general arrangement of an expendable submersible mineclearing vehicle 1 is shown, this comprises a main body portion 2 with a rounded nose 2*a*. The submersible is provided with thrust by two motors 3*a* and 3*b* driving propellors 4*a* and 4*b* and mounted on the ends of outrigger arms 5*a* and 5*b* respectively. Four fixed fins 6 around the tail of the submersible 1 in a cruciform arrangement stabilises the submersible.

The submersible is turned by differential operation of the motors 3*a* and 3*b* while pitch control is achieved by an actuator which moves a battery power pack (not shown) backwards and forwards within the body 2 so as to move the centre of gravity of the submersible relative to its centre of floatation. No mechanism for Yaw control is included since controlled movement about the yaw axis is not required and the fixed fins 6 stablise the submersible and substantially eliminate unwanted yaw movements. This form of control is much simpler and cheaper than the more conventional submerged control system involving movable vanes or fins acting as rudders.

In order to allow the submersible to reach a submerged mine it is made to have negative buoyancy. When the submersible is travelling forwards the power pack, and thus the centre of gravity, is moved backwards so as to place the submersible in a nose up position so that it can move horizontally without sinking, requiring that a minimum forward thrust, and thus speed, be maintained. The amount of forward thrust depending on the nose up angle and degree of negative bouyancy. However it is clearly desirable for the submersible to be able to alter its depth without forward movement and without the expense of conventional submarine mechanisms such as ballast dropping or water tank filling and emptying mechanisms. In order to allow vertical movement without forward movement the motors 3A,B and outrigger arms 5A,B are arranged so that the outrigger arms 5A,B can be pivoted through 90° to rotate the motors 3A,B and propellers 4A,B from a substantially horizontal forward thrust position into a substantially vertical thrust position. With the motors 3A,B and propellers 4A,B in the vertical thrust or hover position the submersible can be moved up or down through the water by altering the motor power to provide vertical thrust greater or smaller than the negative buoyancy of the submersible or by careful balancing of thrust the submersible could be made to hover if desired. It is for this reason the submersible is made with negative buoyancy since if it was neutrally buoyant arrangements to apply motor thrust downwards as well as upward would have to be made and although there are many known methods of doing this such as variable pitch propellers, reversible motors or rotating the motors through 180° rather than 90° these would add to the cost and complexity of the submersible.

Referring to FIGS. 2A,B the arrangement of the motors and outriggers is shown in more detail. In order to minimise the bulk of the submersible when in storage the fin 6 are folded and the outrigger arms 5 are arranged to pivot around pivot point 7B where they attach to a shaft 11B passing into the main body 2 so that the motors 3A,B and propellors 4A,B can be folded into corresponding recesses 8A,B in the sides of the body 2 with the motors in the vertical thrust position, this stowed position is shown on the left hand side of the arrangements of FIGS. 2*a*and 2*b* and in the upper half of FIG. 2D. Two bladed propellors 4 are used so that when the motors 3 are stowed the propellor blades lie fore and aft along the body 2 so that the entire submersible can be placed within a cylindrical tube having an internal radius equal to the outside radius of the body 2 for storage. If desired propellors having more blades and some form of blade folding mechanism could be used instead, but again this would increase the cost and complexity of the submersible.

Figure 2D:
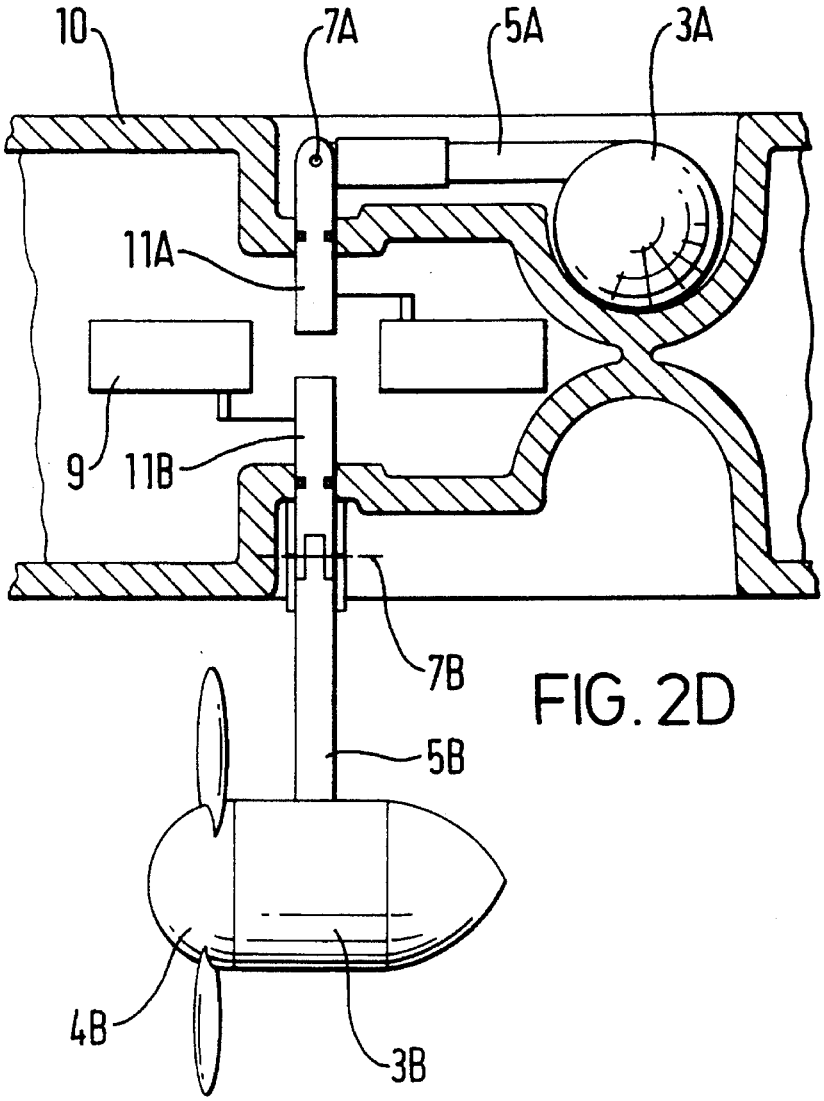
FIG. 2D shows a further cross section through the vehicle of FIG. 1 showing the motors in the stored and horizontal thrust positions and showing the actuators moving the motors.

The shape of the recess 8B is shown in FIG. 2C.

When the submersible is deployed from its storage tube into the water the folded and spring loaded fins 6 automatically spring out once released, fin deployment mechanisms of this type are in common use in missiles so it is not felt necessary to discuss the mechanisms involved further here. Simultaneously a spring loading mechanism (not shown) contained within each of the outrigger arms 5A,B rotates each arm about its respective pivot point 7B, pulling the motors 3A,B and propellors 4A,B out of their respective recesses 8A,B and into the vertical thrust position. Once each arm 5A,B is straight a simple catch-type locking mechanism (not shown) locks it in position preventing further rotation in either direction about the axis 7B. The motors 3A,B and propellors 4A,B can then be rotated between the horizontal and vertical thrust positions by actuators 9 which rotate the shafts 11A,B and so rotate the arms 5A,B as shown schematically in FIG. 2D.

Although this system allows full control of the submersible and is relatively cheap and simple to construct it does have one significant drawback, which is that the shaft 11A,B must pass through a wall 10 of the body 2 to its actuator 9 and this penetration of the wall 10 must be sealed with a rotary seal. This rotary seal is inevitably a weak point in the water tight integrity of the submersible. The alternative of placing the actuators outside the sealed portion of the body 2 would cause considerable reliability problems for the actuators 9 since they would not only be operating in water but would be exposed to outside environmental effects during the long, possibly several years, storage of the submersible before use whereas they can be largely protected from environmental effects during storage when sealed within the submersible hull 2.

Although the system shown employs two shafts 11A,B and two actuators 9, these could be combined into a single shaft 11A,B rotated by a single actuator 9.

In order to overcome this disadvantage and to reduce the cost and complexity of the submersible still further a second embodiment shown in FIGS. 3A,B and 4 can be used.

FIGS. 3A,B and 4 a submersible is shown, the submersible is arranged substantially as before except that the outrigger arms 5A,B lay diagonally across the side of the hull 2 rather than running horizontally along it in the stowed position. When the submersible is released from its storage container a spring mechanism (not shown) within each support arm 5A,B rotates it about a respective pivot point 7 and moves the motor 3A,B and propellor 4A,B out of their recess 8A,B into the hover position. Unlike the example of FIG. 2 however the support arm 5A,B in this case is not able to rotate about the pivot 7 until the arm 5A,B and rotating shaft 11 are arranged in a straight line but is stopped by contacting surfaces of the arm 5A,B and shaft 11 so that the arm 5A,B and shaft 11 together form a dog legged structure with its discontinuity at the pivot point 7. As before a ratchet type mechanism (not shown) prevents further pivoting about the pivot point 7 once this final position is reached.

Due to this dog leg a common shaft 11 passing across the bottom of the submersible body 2 without passing through the wall 10 can be used, the shaft 11 is attached to the body 2 by a pair of brackets 12. Because of the dog leg shape formed by the arm 5A,B and shaft 11 the thrust of each motor 3A,B and its propellor 4A,B is offset relative to the shaft 11. The shaft 11 is arranged for rotation relative to the bracket 12 so the motor thrust tends to cause the shaft 11 to rotate and the direction of the dog leg is arranged so that the motor thrust tends to rotate the shaft 11 such that the thrust induced rotation moves the motors and propellors from the vertical hover position into the horizontal forward thrust position. A simple coil spring 13 is wrapped around the shaft 11 so that the tension of the spring 13 urges the shaft 11 to rotate in a direction which would move the motors from the forward thrust position into the vertical hover position.

As a result when the submersible is deployed the arms 5A,B will unfold placing the motors in the vertical hover position, when the motors then begin producing thrust through the propellors 4A,B this will cause vertical movement of the submersible which can be controlled by varying the amount of thrust, when the thrust becomes sufficient to overcome the tension of the spring 13 the motors will cause the shaft 11 to rotate pulling the motors into the forward thrust position where they can be used to produce forward motion and steering of the submersible. By selection of the amount of negative buoyancy of the submersible and the tension of the coil spring 13 it can be ensured that the thrust level of the motors 3A,B at which transition from hover to forward thrust modes occurs is high enough that the maximum available level of thrust in the hover mode is sufficient to allow the submersible to be maneouvred vertically as desired in operation.

It will be clear that there will be a thrust range in which the thrust of the motors will be balanced by the spring 12 such that the motors will be neither in the forward thrust or the hover positions but in some intermediate position. It may be preferred to prevent the submersible being operated in such intermediate positions, and if so, in operation this range of thrusts can be forbidden to the operator by the motor control going directly from the maximum thrust available in hover mode to the minimum thrust available in forward thrust mode as thrust is increased or vice versa as thrust is decreased.

Generally however it is useful to be able to operate the submersible with the motors in positions intermediate the forward thrust and hover modes in order to make the maneouvring of the submersible more flexible. Specifically this allows the thrust to have both horizontal and vertical components so as to allow slow forward movements at speeds which would otherwise be too low to prevent the submersible sinking.

Stops (not shown) limit the rotation of the shaft 11 to that required to go from the hover mode to the vertical thrust mode only and stop further rotation beyond these limits in either direction.

In practice it may not be considered necessary to allow the vehicle to maneouvre vertically upward in hover mode mode although the ability to descend at a controlled rate vertically in hover mode would still be desirable and in this case the spring tension and submersible negative buoyancy would be arranged so as to give the desired minimum sink rate.

The degree of negative buoyancy of the submersible and thus its sink rate will vary in practice due to variations in water salinity, temperature and pressure and so it may be desirable to provide a adjuster for the spring 13 to allow its tension to be altered before launch of the submersible, this could be done by a servo-mechanism or manual adjuster mounted on the submersible or storage cannister allowing the tension to be preset to the allow for the water salinity, temperature and pressure expected in the vicinity of the target mine, alternatively temperature compensation could be made automatic by the use of a spring or spring adjuster including bi-metallic elements.

This design of propulsion system is preferred because it eliminates the requirement for a rotary seal passing through the wall 10 and also the need for actuators to transfer from hover to forward thrust modes and so reduces the cost and complexity of the expendable submersible and reduces the complexity of the associated control equipment because there are fewer actuators to control.

I claim:

1. A submarine propulsion system for use in a submersible vehicle comprising two motors mounted on support arms and arranged when not in use with each motor stored in a respective recess in the submersible vehicle and the support arms being arranged for rotation about two axes relative to the submersible vehicle so that rotation about the first axis moves the motor out of the recess and into an operating position and rotation of the support arm about the other axis moves the motor between two operating positions in which it generates thrust in two perpendicular directions, rotation of the support about the second axis being controlled by the amount of thrust generated by the motors.

2. A system as claimed in claim 1 in which the two perpendicular directions are horizontal and vertical.

3. A system as claimed in claim 1 in which the vehicle is an expendable mineclearer.

* * * * *